United States Patent [19]

Fritzsche et al.

[11] Patent Number: 4,999,883

[45] Date of Patent: Mar. 19, 1991

[54] METHOD OF AND APPARATUS FOR FILLING A CAN WITH SLIVER

[75] Inventors: Peter Fritzsche; Martin Schwager; Hans Speich, all of Winterthur, Switzerland

[73] Assignee: Rieter Machine Works Ltd., Winterthur, Switzerland

[21] Appl. No.: 334,871

[22] Filed: Apr. 7, 1989

[30] Foreign Application Priority Data

Apr. 11, 1988 [CH] Switzerland ..... 01321/88

[51] Int. Cl.[5] ..... D01G 27/00

[52] U.S. Cl. ..... 19/159 R; 19/157

[58] Field of Search ..... 19/157, 159 R, 159 A

[56] References Cited

U.S. PATENT DOCUMENTS

| | | | |
|---|---|---|---|
| 1,040,566 | 10/1912 | Mills | 19/159 R |
| 2,866,232 | 12/1958 | West et al. | 19/159 R |
| 3,241,196 | 3/1966 | Fornes et al. | 19/159 R |
| 3,402,433 | 9/1968 | Schwalm | 19/159 R |
| 3,411,189 | 11/1968 | Whitehurst | 19/159 R |
| 3,432,891 | 3/1969 | West | 19/157 |
| 3,533,138 | 10/1970 | Whitehurst | 19/157 |
| 3,728,760 | 4/1973 | Johns | 19/159 R |
| 3,938,222 | 2/1976 | Garrison | 19/159 R |
| 4,815,171 | 3/1989 | Klüttermann | 19/159 R |

FOREIGN PATENT DOCUMENTS

| | | |
|---|---|---|
| 2801010 | 5/1979 | Fed. Rep. of Germany . |
| 3033371 | 4/1982 | Fed. Rep. of Germany . |
| 3033371 | 4/1982 | Fed. Rep. of Germany . |
| 3524601 | 1/1987 | Fed. Rep. of Germany . |
| 357381 | 12/1905 | France . |
| 7710981 | 11/1977 | France . |
| 357007 | 10/1961 | Switzerland . |
| 1154834 | 6/1969 | United Kingdom . |
| 2056516 | 3/1981 | United Kingdom . |

*Primary Examiner*—Werner H. Schroeder
*Assistant Examiner*—Michael A. Neas
*Attorney, Agent, or Firm*—Sandler, Greenblum & Bernstein

[57] ABSTRACT

For draft- and trouble-free coiling of a sliver arriving from a deflection roll into a sliver can, there is provided a coiler roll which, in cooperation with a nip or pinch roll, guides the sliver through an infeed funnel and deposits the sliver directly upon sliver coils already located in the sliver can. For this purpose, the circumference of the coiler roll projects by a predetermined amount deeper into the sliver can than the underside or lower surface of a coiler plate.

24 Claims, 5 Drawing Sheets

Fig. 3
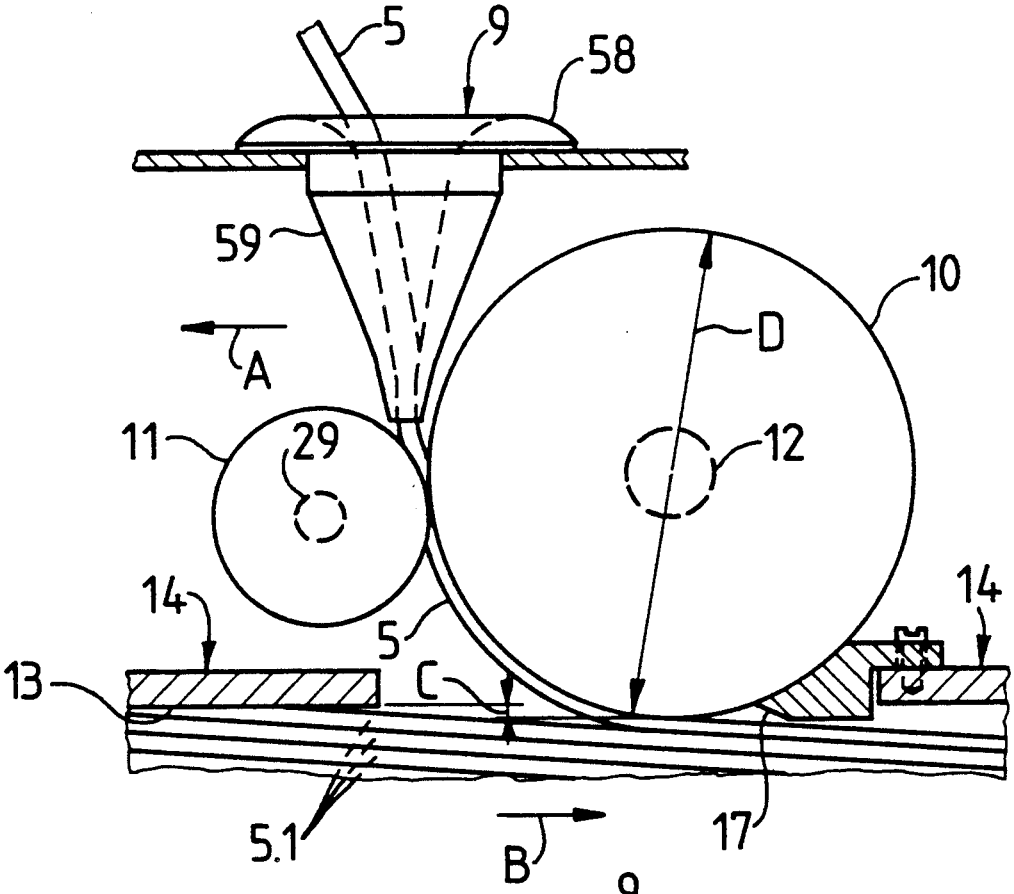
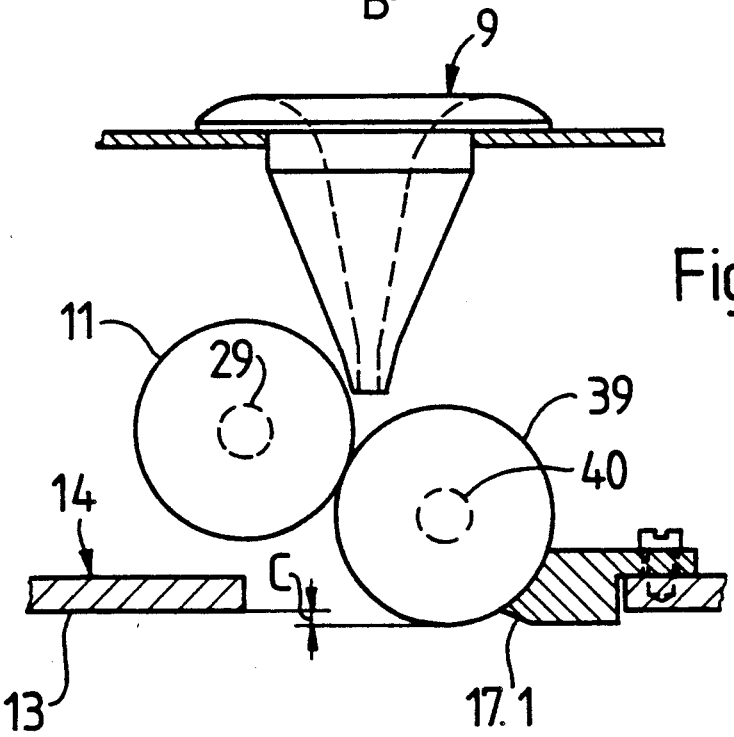
Fig. 4

Fig. 11
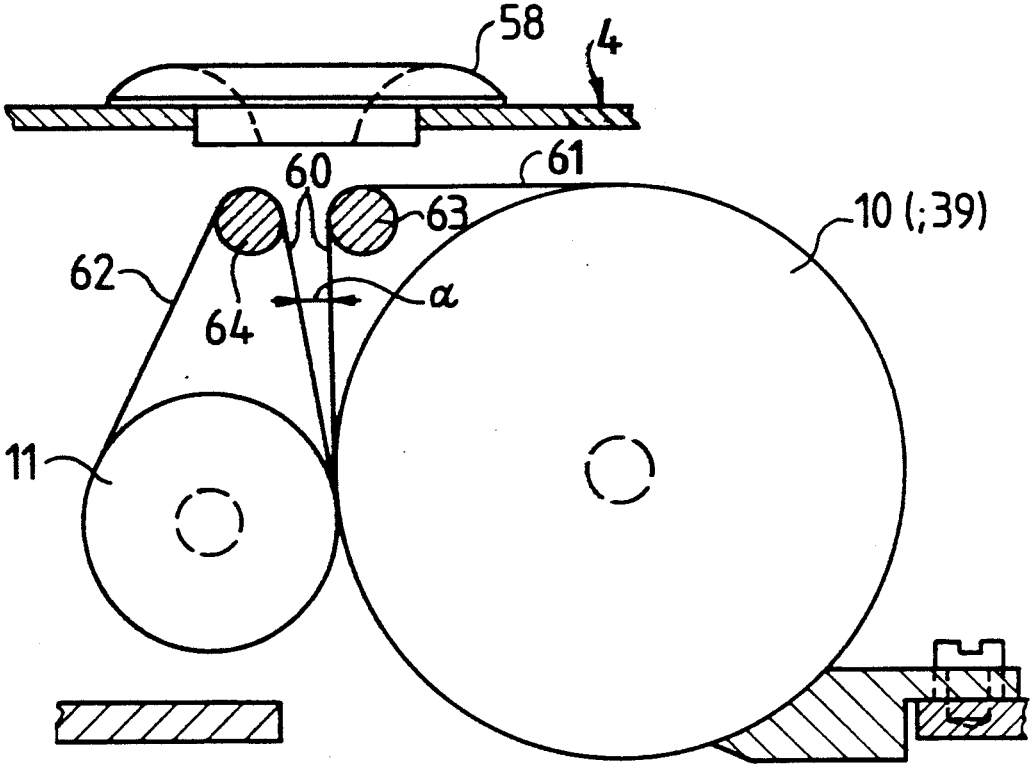
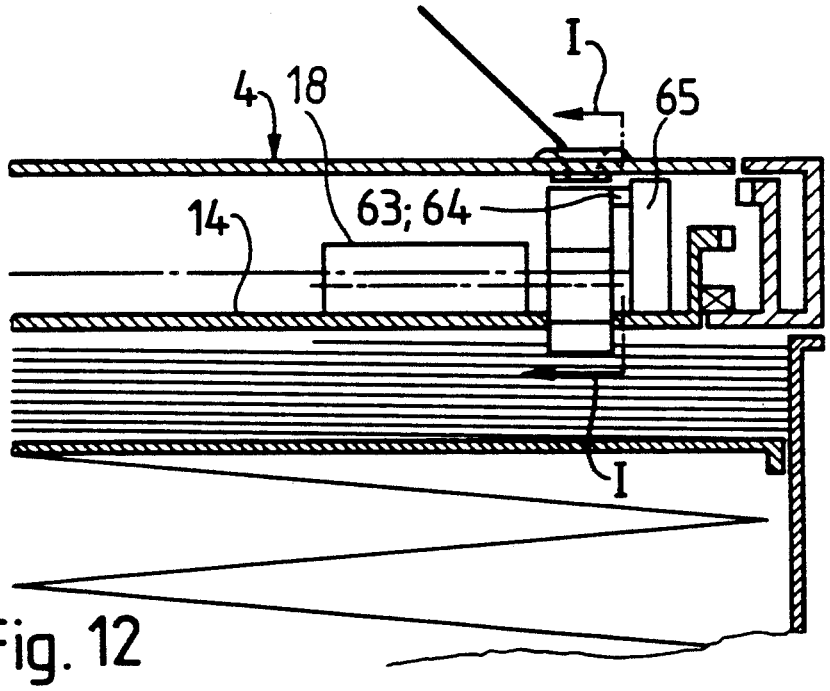
Fig. 12

METHOD OF AND APPARATUS FOR FILLING A CAN WITH SLIVER

BACKGROUND OF THE INVENTION

The present invention broadly relates to coiling of strand or filamentary material into a container or can for storage or subsequent processing and, pertains more specifically to a new and improved method of filling a can with sliver which is coiled into the can by means of a pair of rolls. The present invention also relates to a new and improved apparatus for filling a can with sliver or the like.

It is known from prior art that can filling means comprise a so-called coiler plate provided with a conventionally S-shaped sliver guide tube by means of which the sliver is guided so as to be coiled into the can located beneath the coiler plate.

At the inlet of the sliver guide tube there is usually provided a pair of rolls or rollers which guides the sliver through the inlet orifice or port of the sliver guide tube into the latter and forwardly advances the sliver.

Such a can filling device is disclosed, for example, in German Published Patent Application No. 3,524,601, published Jan. 15, 1987. In this known device it is apparent that the sliver, immediately after leaving the outlet orifice or port of the sliver guide tube, is directly delivered into the can, i.e. upon the sliver layers or coils already present therein. Therefore, it is necessary for the sliver to be pulled out of the sliver guide tube by the rotation of the coiler plate relative to the sliver layers or coils in the can as well as by the friction between the sliver to be deposited in the can and the sliver already coiled therein. As a result, there is some drafting of the sliver within the sliver guide tube, and although such drafting is minor, it is not accurately defined. Differences in drafting resulting therefrom must be compensated during the subsequent sliver processing operations.

Another possible disadvantage of this known can filling device is that the sliver may expand in the sliver guide tube, resulting in additional friction therein. This is particularly possible in the case of slivers having a high synthetic or man-made fiber content.

To remedy the aforementioned drawback of the prior art construction, a second pair of rolls or rollers can be provided at the coiler plate as disclosed, for example, in German Patent No. 2,801,011, published May 23, 1979. This second pair of rolls or rollers pulls the sliver through the sliver guide channel. The axes of these rolls or rollers are substantially parallel to the axis of the coiler plate and thus substantially perpendicular to the latter.

This second prior art construction, which in fact constitutes an improved can filling device in relation to the first prior art construction hereinbefore discussed, still has the disadvantage of possible sliver drafting within the sliver guide tube and also the drawback that a second pair of driven rolls or rollers has to be provided. This roll or roller arrangement is relatively complicated and requires a corresponding constructional expenditure.

SUMMARY OF THE INVENTION

Therefore with the foregoing in mind it is a primary object of the present invention to provide a new and improved method of and apparatus for filling a can or receptacle or the like with filamentary material such as a sliver or the like which is coiled into the can or receptacle by means of a pair of rolls, which method does not suffer from the aforementioned drawbacks and shortcomings of the prior art methods and constructions.

Another and more specific object of the present invention aims at providing a new and improved method of and apparatus for filling a sliver can with sliver such that the sliver is coiled into the sliver can with substantially no drafting thereof.

Now in order to implement these and still further objects of the invention which will become more readily apparent as the description proceeds, the method of filling a can or receptacle or the like with filamentary material such as a sliver is manifested, among other things, by the steps of arranging the pair of rolls such that one roll of this pair of rolls acts as a coiler roll and depositing the sliver by means of the coiler roll directly and immediately upon sliver layers or coils or loops already present in the sliver can.

The step of directly and immediately depositing the sliver advantageously entails causing the sliver to be coiled or convoluted into the sliver can with a predetermined pressure upon the sliver layers or coils or loops already present in the sliver can.

Furthermore, it is advantageous to guide the sliver through sliver guide means arranged directly upstream of the pair of rolls and to cause the sliver to pass through such sliver guide means at a speed or velocity which is substantially equal to the circumferential speed of the coiler roll of the pair of rolls.

As alluded to above, the invention is not only concerned with the aforementioned method of filling a can or receptacle or the like with sliver or the like, but also relates to a new and improved construction of an apparatus for filling a can or receptacle or the like with filamentary material such as a sliver.

Generally speaking, the inventive apparatus for filling a can or the like with sliver or the like comprises a can coiler provided with primary sliver guide means for guiding the sliver substantially in or along the axis of rotation of a coiler part or section forming part of the can coiler, and with a pair of rolls or rollers revolving with the coiler part or section for delivering the sliver or the like into a can located beneath the pair of rolls or rollers.

In an advantageous embodiment of the inventive apparatus, one roll or roller of the pair of rolls or rollers is structured as a sliver coiler roll or roller which projects into the can defining a sliver can.

The sliver coiler roll or roller is advantageously arranged with its circumferential surface projecting by a predetermined amount from the coiler part or section into the sliver can. In this manner, the sliver coiler can directly deposit the sliver upon sliver layers or coils or layers already present in the sliver can.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference wherein:

FIG. 3 shows, on an enlarged scale, a detail of the sliver coiler illustrated in FIG. 1 looking in the direction of the arrow E in FIG. 1;

FIG. 4 shows, on the enlarged scale of FIG. 3, a variant of the detail illustrated in FIG. 3;

FIG. 11 shows, on the enlarged scale of FIG. 3 and looking in the direction of the arrows I—I in FIG. 12, a further variant of the detail illustrated in FIG. 3;

FIG. 12 shows, on an enlarged scale, part of the sliver coiler shown in FIG. 1 and a detail illustrated in FIG. 11;

DETAILED DESCRIPTION OF THE PREFERRED EMBODIMENTS

Figure 1:
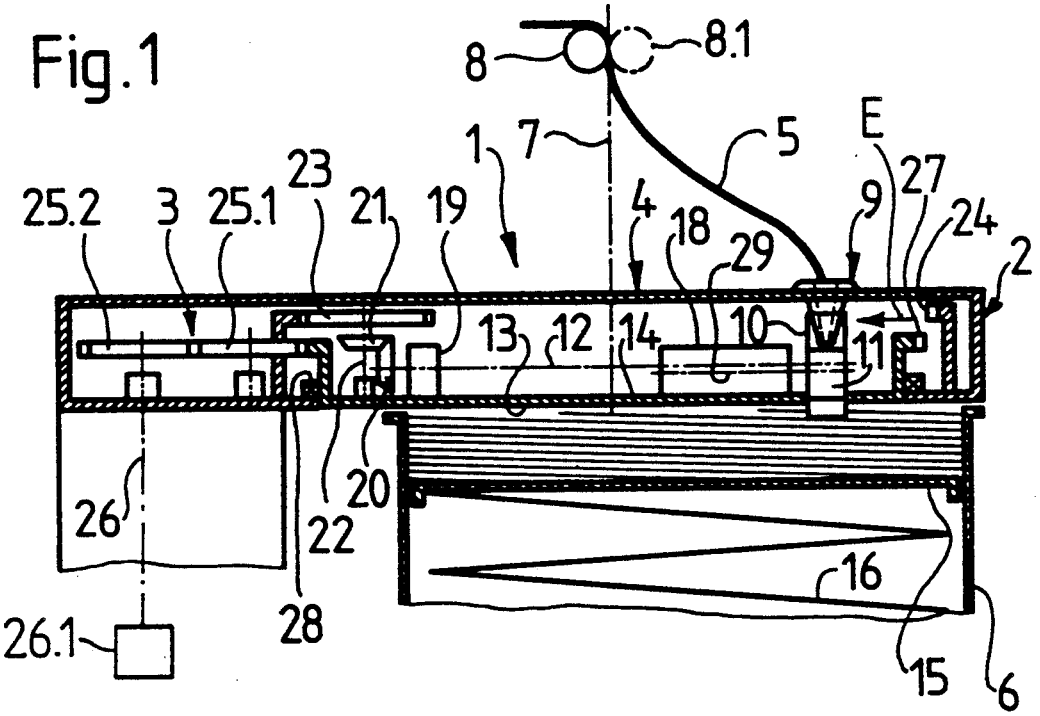
FIG. 1 schematically shows a side view, partially in section, of a sliver coiler constructed according to the invention.

Describing now the drawings, it is to be understood that to simplify the showing thereof, only enough of the apparatus for filling a sliver can with filamentary material such as a sliver or the like has been illustrated therein as is needed to enable one skilled in the art to readily understand the underlying principles and concepts of this invention. Turning attention now specifically to FIG. 1 of the drawings, a can coiler 1 illustrated therein by way of example and not limitation comprises a machine housing 2 containing a drive or driving unit 3 and a coiler part or section 4 located in the housing part 2 and rotatably driven by the drive or driving unit 3.

Suitable filamentary material, hereinafter generally referred to as a sliver 5 is introduced into a sliver can 6 by means of this coiler part or section 4. The sliver can 6 rotates by means of a suitable turntable or rotary plate or the like not particularly shown in the drawing. The coiler part or section 4 simultaneously rotates about an axis of rotation 7, so that the sliver 5 is coiled into the sliver can 6 in a manner known as such in continuous cycloidal loops or convolutions or coils.

The sliver 5 is fed to the coiler part or section 4 by means of a deflection roll or roller 8 and subsequently taken over by an inlet funnel or trumpet 9 comprising a port or orifice portion 58 (FIG. 3) and a, for instance, rigid funnel or trumpet part 59 which is part of the coiler part or section 4.

A second roll or roller 8.1 may be operatively associated with the deflection roll or roller 8 so that the sliver 5 or the like can be fed to the inlet funnel or trumpet 9 while nipped between these two rolls or rollers 8 and 8.1. The nip or pinch line (not shown) of these two rolls or rollers 8 and 8.1 should intersect the axis of rotation 7 of the coiler part or section 4 and advantageously should be substantially perpendicular to such axis of rotation 7 of the coiler part or section 4.

Downstream of the inlet funnel or trumpet 9, the sliver 5 is taken over by a coiler roll or roller or wheel 10 and a nip or pinch roll or roller 11 coactingly associated therewith.

The coiler roll or roller 10 has a diameter D (cf. FIG. 3) which is selected such that, when a shaft 12 rotatably supporting the coiler roll or roller 10 is in a given or predetermined position, the circumference of the coiler roll or roller 10 extends by a predetermined amount C further or deeper into the sliver can 6 than the underside or lower surface 13 of a coiler plate or plate member 14. Since the circumference of the coiler roll or roller 10 projects deeper into the sliver can 6 by the predetermined amount C, the coiler roll or roller 10 deposits or coils the sliver 5 directly upon sliver loops or layers or coils 5.1 already located in the sliver can 6.

The predetermined roll protruding amount C may be selected, for example, in the range of 1 to 10 mm. However, the magnitude of the amount C depends on the required amount of pressure which is to be exerted by the delivered or inbound sliver 5 on the sliver loops or layers or coils 5.1 already located in the can, and is selected according to discretion.

The coiler plate or plate member 14 fulfils the known function of compressing the coiled sliver loops or layers 5.1 deposited in the sliver can 6 in combination with a spring-loaded spring plate or disk 15. The spring for loading the spring plate or disk 15 is generally designated by reference numeral 16 and is supported in a manner known per se at the base of the sliver can 6. Such base of the silver can 6 is not particularly shown in the drawing in order to simplify the illustration.

It is readily conceivable that the circumferential speed or velocity of the coiler roll or roller 10 is selected such that there is no relative velocity between the inbound sliver 5 intended to be coiled and the sliver loops or layers or coils 5.1 already present in the sliver can 6. The sliver can 6 rotates, for example, in the direction B and the coiler part or section 4 rotates, for example, in the direction A, as shown in FIG. 3. The type of loop formation in the sliver can 6, when the sliver can 6 and the coiler plate 14 are in rotation, is cycloidal.

A stripper or stripper member 17 or equivalent structure is provided in order to prevent fibers from adhesively clinging to the coiler roll or roller 10.

The shaft 12 provided to drive the coiler roll or roller 10 is rotatably mounted, on the one hand, in a bearing 18 located directly at the coiler roll or roller 10 and, on the other hand, in a bearing 19. The bearings 18 and 19 are appropriately secured at the coiler plate 14. In the immediate proximity of the bearing 19, a bevel gear 20 is mounted at the rotatable shaft 12 in a manner such as to be non-rotatable relative thereto. The bevel gear 20 engages another bevel gear 21 which is mounted at a rotatable shaft 22 in a manner such as to be non-rotatable relative thereto. A drive gear 23 is also mounted at the rotatable shaft 22 in a manner such as to be non-rotatable relative thereto.

The drive gear 23 is a gear wheel which, in turn, meshes with an internal gear or gear member 24 which is part of the machine housing 2.

The transmission wheels 25.1 and 25.2 are rotatably mounted in the drive or driving unit 3 which is rigidly associated with the machine housing 2. The transmission wheel 25.2 is provided at a rotatable drive shaft 26 in a manner such as to be non-rotatable relative thereto. This drive shaft 26 is driven by a suitable drive motor, schematically indicated by reference numeral 26.1 in FIG. 1. The transmission wheels 25.1 and 25.2 are meshing gear wheels or gears.

The transmission wheel or gear 25.1 also meshes with an externally toothed ring gear 27 operatively associated with the coiler plate 14, so that the coiler plate 14 can be rotated about the axis of rotation 7 thereof. This, in turn, drives the drive gear 23 and, via rotatable shaft 22, the bevel gear 21. The bevel gear 21 rotates the bevel gear 20 and thus the rotatable shaft 12 and, with the latter, the coiler roll or roller 10.

The coiler plate 14 is appropriately positioned in its vertical axial position shown in FIG. 1 and rotatably mounted by means of a rotary bearing 28 rigidly mounted at the machine housing 2.

The nip or pinch roll or roller 11 is rotatably mounted by means of a rotatable shaft 29 and can be driven either freely, i.e. by way of friction between the sliver 5 and the nip or pinch roll or roller 11 or, as an alternative, by means of a power transmission gearing or power transmission from the shaft 12. Such power transmission gearing or power transmission can be driven directly by means of gear wheels, as will be explained hereinafter in conjunction with the rolls or rollers 8 and 8.1, or via belt drives or toothed belt drives.

Figure 2:
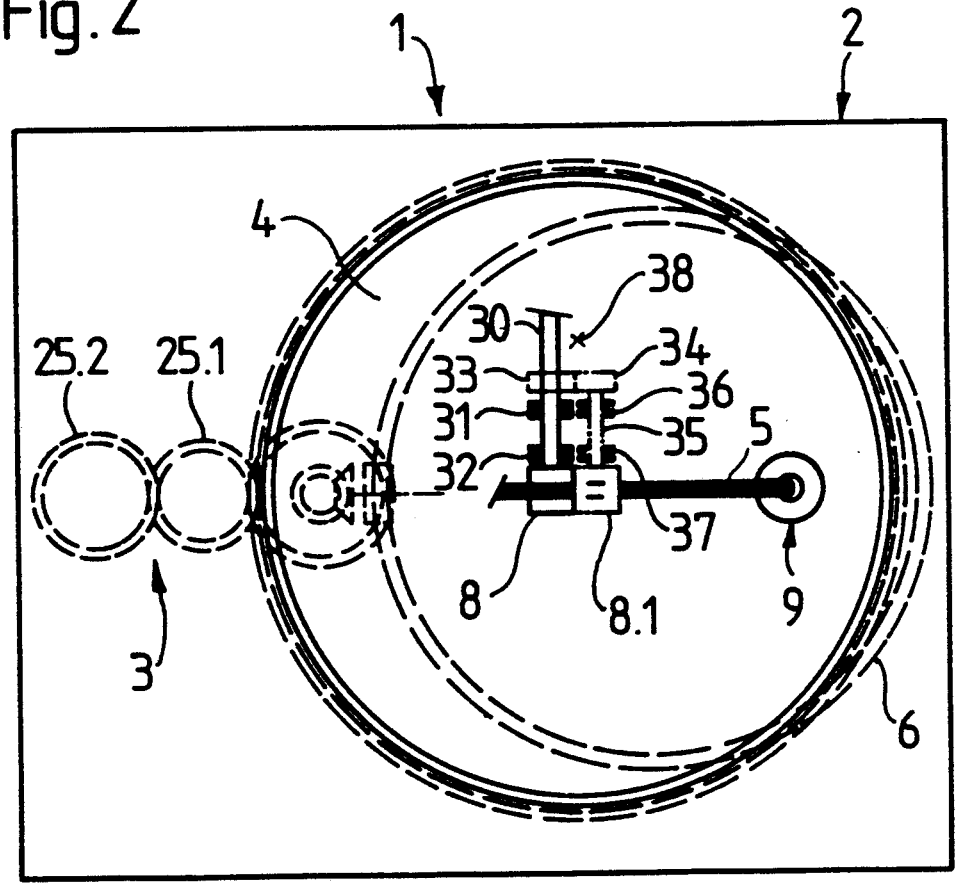
FIG. 2 is a top plan view of the sliver coiler shown in FIG. 1.

As an example of such a power transmission gearing or power transmission, FIG. 2 shows the mounting of a rotatable shaft 30 which drives the deflection roll or roller 8 and which, on the one hand, is rotatably mounted in bearings 31 and 32 and, on the other hand, has a drive gear wheel or gear 33 mounted thereat in a manner such as to be non-rotatable relative thereto. Drive gear wheel or gear 33 meshes with a gear wheel or gear 34 which is mounted at a rotatable shaft 35 so as to be non-rotatable relative thereto, in order to drive the roll or roller 8.1 in case the same is provided.

The bearings 31 and 32 are operatively associated with a not particularly illustrated support which is rigidly arranged at the coiler plate 14, while the rotatable shaft 35 is mounted for rotation in bearings 36 and 37. These bearings 36 and 37 are provided in a not particularly illustrated support which is pivotable about a here only symbolically illustrated axis of rotation 38 which is substantially perpendicular to the coiler plate 14, so that the second roll or roller 8.1 can be pivoted away from the deflection roll or roller 8. The biasing or loading force between the two rolls or rollers 8 and 8.1 is provided by suitable spring-loading not particularly shown in the drawings.

In the same manner as the bearings 36 and 37, the bearings of the rotatable shaft 29 of the nip or pinch roll or roller 11 can be provided in a pivotable support which is spring-loaded (not shown), so that the nip or pinch roll or roller 11 can be pressed against the coiler roll or roller 10 with a biasing or loading force corresponding to the aforementioned spring loading, in order to generate the required friction between the sliver 5 and the coacting pair of rolls or rollers 10 and 11. It is also possible, as described in connection with the shafts 30 and 35, to provide each of the shafts 12 and 29 with respective gear wheels or gears, which, as described in connection with the drive gear wheel or gear 33 and the gear wheel or gear 34, mesh with one another in order to achieve a positive drive of the nip or pinch roll or roller 11 instead of a frictional drive by means of the friction prevailing between the nip or pinch roll or roller 11 and the sliver 5. The support accommodating the bearings for the rotatable shaft 29 of the nip or pinch roll or roller 11 may be also mounted, as described in connection with the axis of rotation 38, to pivot about a not particularly shown pivot axis extending substantially perpendicular to the coiler plate 14, so that the spring-loaded biasing previously described in connection with the pair of rolls or rollers 8 and 8.1 is also applicable for the pair of rolls or rollers 10 and 11.

FIG. 4 illustrates a variant of the coiler roll or roller 10 shown in FIG. 3. In particular, here a coiler roll or roller 39 does not have a substantially larger diameter than the therewith coacting nip or pinch roll or roller 11, but is arranged such that its circumference or outer surface likewise projects into the sliver can 6 by the amount C just like the circumference of the coiler roll or roller 10. The rotatable shaft 40 for driving the coiler roll or roller 39 is mounted in the same manner as the rotatable shaft 12 of the coiler roll or roller 10. It will be apparent that since the rotatable shaft 40 is positioned at a lower level than the rotatable shaft 12, corresponding modifications must be provided with respect to the position of the bevel gears 20 and 21 in the transmission arrangement shown in FIG. 1. The coiler roll or roller 39 also is provided with a stripper or stripper member 17.1 or the like.

Figure 5:
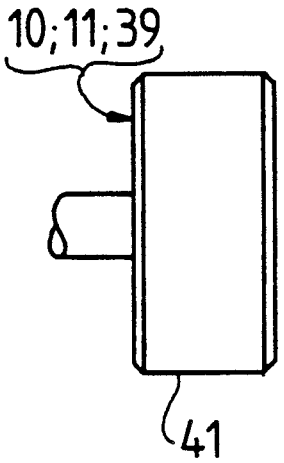
FIG. 5 schematically shows a first embodiment of a roll or roller which can be used in the sliver coiler of FIGS. 1 to 4.
Figure 6:
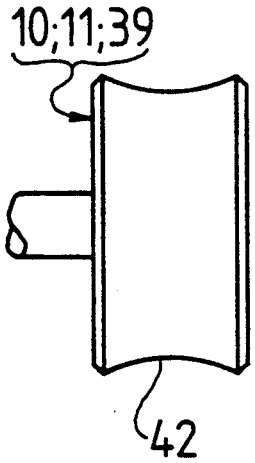
FIG. 6 schematically shows a second embodiment of a roll or roller which can be used in the sliver coiler of FIGS. 1 to 4.
Figure 7:
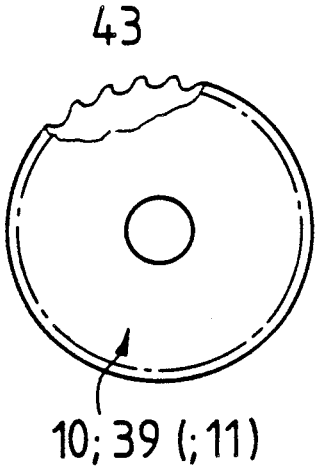
FIG. 7 schematically shows a third embodiment of a roll or roller which can be used in the sliver coiler of FIGS. 1 to 4.

FIG. 5 shows a substantially cylindrical circumferential roll surface 41 which can be used for the coiler rolls or rollers 10 and 39 and the nip or pinch roll or surface 42 depicted in FIG. 6, while a circumferential roll surface provided with channels or flutings 43 and shown in FIG. 7 can be used solely for driven rolls or rollers. The number of channels or flutings distributed at the circumference of the roll or roller may vary and, for example, two channels offset through 180° with respect to one another may be sufficient to feed or convey the sliver 5.

Figure 8:
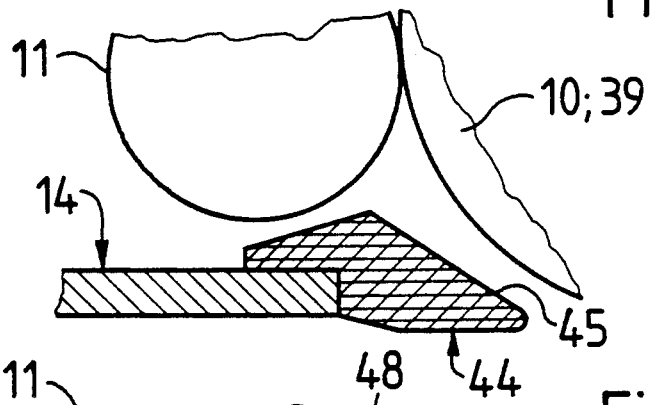
FIG. 8 schematically shows a first embodiment of a sliver guide element which can be used in the sliver coiler of FIGS. 1 to 4.

FIG. 8 shows an auxiliary sliver guide element 44 associated with the coiler plate 14 and having a sliver guide surface 45 which faces or confronts the circumferential surface of the coiler rolls or rollers 10 and 39, respectively, and guides or conducts the sliver 5 or the like towards the coiler rolls or rollers 10 and 39, respectively. The sliver guide element 44 is made of plastics material which does not become statically charged and is rigidly secured at the coiler plate 14.

Figure 9:
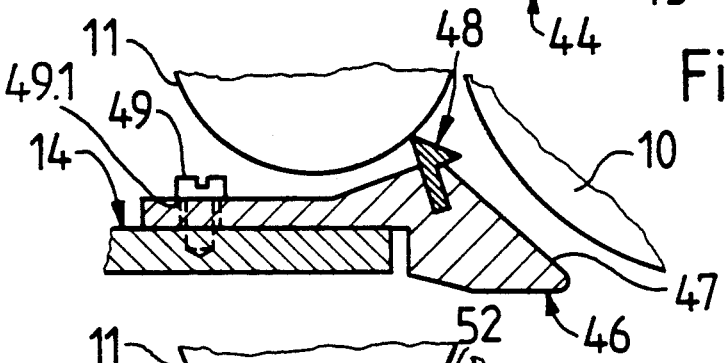
FIG. 9 schematically shows a second embodiment of a sliver guide element provided with a stripper which can be used in the sliver coiler of FIGS. 1 to 4.

FIG. 9 shows an auxiliary sliver guide element 46 containing a sliver guide surface 47 and an additional stripper 48 or the like which prevents fibers from catching on the nip or pinch roll or roller 11. To provide optimum setting of the sliver guide element 46 against the nip or pinch roll or roller 11, the sliver guide element 46 is secured at the coiler plate 14 by means of, for instance, a screw or threaded bolt 49 in a suitable slot shown in broken lines indicated by reference numeral 49.1 and provided in the sliver guide element 46 such that the position of the sliver guide element 46 can be selected in a range predetermined by the slot.

Figure 10:
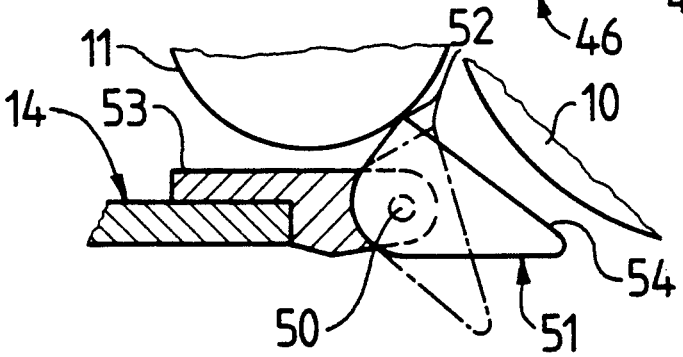
FIG. 10 schematically shows a third embodiment of a sliver guide element provided with a pivot and a stripper edge which can be used in the sliver coiler of FIGS. 1 to 4.

FIG. 10 shows a sliver guide element 51 pivotably mounted about a pivot shaft or pivot pin 50 and having a stripper edge 52. The pivot shaft or pivot pin 50 is arranged in a carrier or support element 53 which is secured at the coiler plate 14. Furthermore, the sliver guide element 51 comprises a sliver guide surface 54.

The advantage of the sliver guide element 51 is that it is arranged such as to pivot or tilt by its own weight into the position shown in dash-dotted lines in FIG. 10 during such time as there is no sliver 5.1 in the sliver can 6. Since in the position depicted in dash-dotted lines, the sliver guide surface 54 possesses a far greater slope or inclination than in the position shown in full lines, the advantage is essentially seen in the fact that the sliver 5 is reliably prevented from accumulating at the sliver guide surface 54 in the dash-dotted position and, on the other hand, in the fact that the stripper edge 52 can act as a stripper in the operating position of the sliver guide element 51 shown in full lines.

A variant of the arrangement of FIG. 3 is shown in FIG. 11. Only the port or orifice portion 58 is provided instead of the complete inlet funnel or trumpet 9, and the funnel or trumpet part 59 is replaced by a pair of aprons 60 comprising an apron 61 and an apron 62. The apron 61 is trained or guided around the coiler roll or roller 10 as well as around a deflection roll or roller 63. The apron 62 is trained or guided around the nip or pinch roll or roller 11 and around a deflection roll or roller 64. By means of the pair of aprons 60, the sliver 5 or the like is pulled through the port or orifice portion 58, and the aperture angle $\alpha$ of the pair of aprons 60 should be as small as possible, i.e. just a few degrees, for example, 6 degrees.

FIG. 12 shows a bearing support 65 which accommodates the deflection rolls or rollers 63 and 64. As in the case of the bearing 18, this bearing support 65 is also secured at the coiler plate 14.

Figure 13:
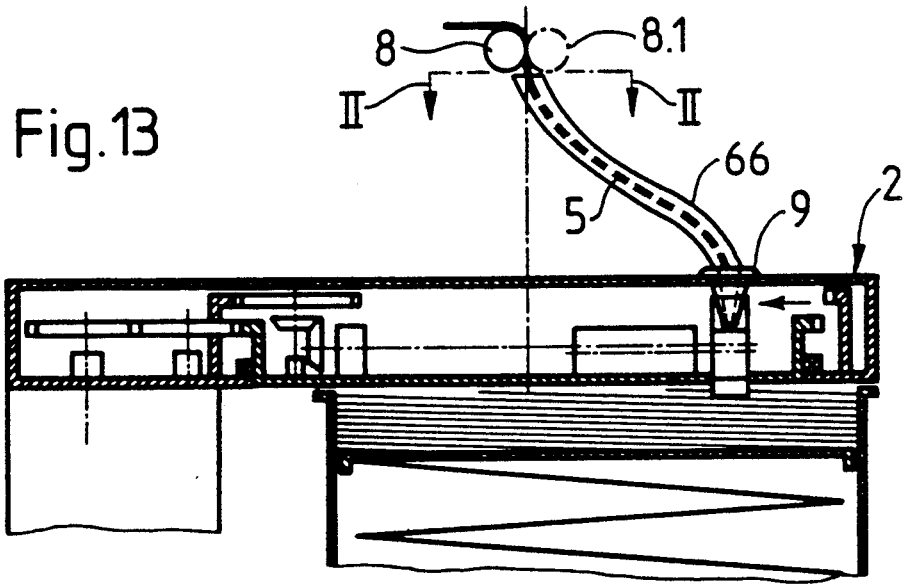
FIG. 13 shows a variant of the sliver coiler illustrated in FIG. 1.
Figure 14:
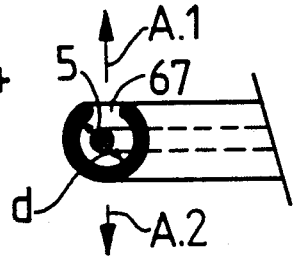
FIG. 14 shows, on an enlarged scale, a sectional view taken substantially along the line II—II in FIG. 13.
Figure 15:
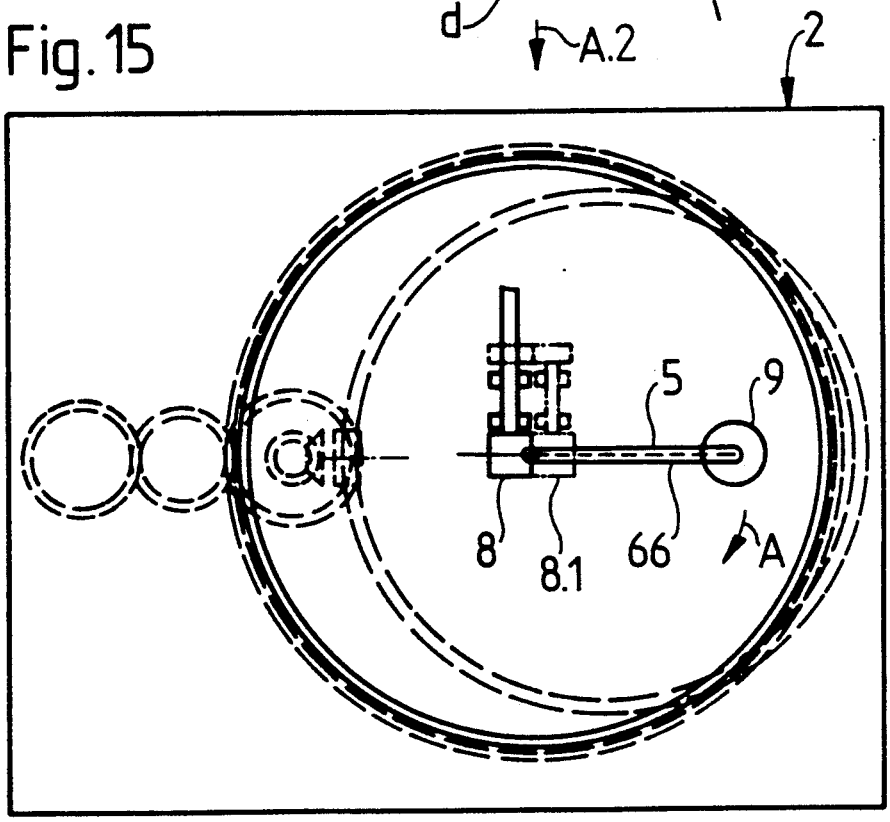
FIG. 15 shows a variant of the sliver coiler illustrated in FIG. 2.

FIGS. 13, 14 and 15 show a variant of the apparatus depicted in FIGS. 1 and 2 inasmuch as the sliver 5 is no longer unprotectedly guided by the deflection or feed rolls or rollers 8 and 8.1 up to the inlet funnel or trumpet 9. There is provided a guide channel 66 which is connected to the inlet funnel or trumpet 9. In a variant of the guide channel 66 such has a wind-screened channel opening 67 on the side remote from the direction of movement A.2 (FIG. 14).

The inner width d of the guide channel 66 amounts to twice to four times the diameter of the sliver 5 in order to ensure that the sliver 5 is not obstructed, but simply supported and protected, by the guide channel 66 as it passes through. This inner width d can be, however, arbitrarily increased, the maximum width ranging from the mass of the guide channel 66 to be revolvingly moved or the unnecessary or excessive size thereof to any reasonable value.

It will also be understood that the inner surface of the guide channel 66 has a conventional surface finish to prevent fibers of the sliver 5 from clinging or sticking to the inner wall of the guide channel 66.

It is also not essential for the guide channel 66 to have the cross-section shown in FIG. 14, and basically elliptical or rectangular cross-sectional shapes are also possible. The inner cross-sectional shape of the guide channel 66 and that of the inlet funnel or trumpet 9 are usually adapted to one another.

As designated with the movement arrow A.1 in FIG. 14, the channel opening 67 may also be disposed at the front, i.e. the wind side of the guide channel 66, in the direction of movement, so that a pressure head forming in the guide channel 66, and the consequent direction of flow of the air in the direction of the inlet funnel or trumpet 9, surrounds the sliver 5 with air and accompanies it accordingly. If the channel opening 67 is provided at the wind side, the resulting air flow depends upon the ratio of the width of the channel opening 67 and the width d of the guide channel 66, for a given circumferential velocity or speed, and this is advantageously determined empirically.

While there are shown and described present preferred embodiments of the invention, it is to be distinctly understood that the invention is not limited thereto, but may be otherwise variously embodied and practiced within the scope of the following claims.

What we claim is:

1. A method of filling a sliver can with sliver, comprising the steps of:

infeeding the sliver to pass between a pair of rollers;

delivering the sliver into the sliver can by means of said pair of rollers and thereby forming said coiled sliver layers in the sliver can;

during said step of forming said coiled sliver layers in said sliver can, forming individual coils of said coiled sliver layers by using one roll of said pair of rolls as a sliver coiler roll; and depositing said individual coils of said coiled sliver layers by placing the delivered sliver by means of said sliver coiler roll directly and immediately upon an uppermost coiled sliver layer of said coiled sliver layers already deposited in the sliver can during said filling of said sliver can with sliver.

2. The method as defined in claim 1, further including the steps of:

guiding the sliver through sliver guide means located directly upstream of said pair of rolls as viewed in an infeed direction of the sliver to said pair of rolls; and passing the sliver through said sliver guide means at a speed substantially equal to a predetermined circumferential speed of said sliver coiler roll.

3. A method of filling a sliver can with sliver, comprising the steps of:

infeeding the sliver to pass between a pair of rollers;

delivering the sliver into the sliver can by means of said pair of rollers and thereby forming said coiled sliver layers in the sliver can;

during said step of forming said coiled layers in said sliver can, forming individual coils of said coiled sliver layers by using one roll of said pair of rolls as a sliver coiler roll; and depositing said individual coils of said coiled sliver layers by placing the delivered sliver by means of said sliver coiler roll directly and immediately upon an uppermost coiled sliver layer of said coiled sliver layers already deposited in the sliver can at a predetermined pressure upon said uppermost coiled sliver layer.

4. The method as defined in claim 3, wherein:

said step of depositing the delivered sliver at a predetermined pressure upon said uppermost sliver layer includes depositing said coiled sliver layers containing said uppermost sliver layer, upon a disc which is displaceable within said sliver can relative to said sliver coiler roll; and spring loading said disc in a direction toward said sliver coiler roll for applying said predetermined pressure to said delivered sliver located between said sliver coiler roll and said uppermost coiled sliver layer of said coiled sliver layers deposited upon said disc.

5. An apparatus for filling a sliver can with sliver, comprising:

a can coiler;

a primary sliver guide means;

a coiler section defining part of said can coiler and having a predetermined axis of rotation;

said primary sliver guide means guiding the sliver substantially along said predetermined axis of rotation of said coiler section;

said can coiler including a pair of rolls revolving with said coiler section;

said pair of rolls serving to deliver the sliver and form coiled sliver layers in said sliver can located below said pair of rolls;

one roll of said pair of rolls defining a sliver coiler roll; and said sliver coiler roll projecting into the sliver can for placing delivered sliver directly and immediately upon an uppermost coiled sliver layer of coiled sliver layers already deposited in said sliver can.

6. The apparatus as defined in claim 5, wherein:

said sliver coiler roll possesses a circumferential surface;

said sliver coiler roll together with said circumferential surface being arranged to project by a predetermined amount from said coiler section into the sliver can; and said delivered sliver being held at a predetermined pressure between said uppermost coiled sliver layer and said circumference of said sliver coiler roll under the direct and immediate action of said sliver coiler roll.

7. The apparatus as defined in claim 5, further including:

a counter roll cooperating with said sliver coiler roll;

auxiliary sliver-guide means;

said sliver coiler roll having a circumference; and said auxiliary sliver-guide means being located downstream of said counter roll as viewed in a travel direction of the sliver through said pair of rolls and opposite said sliver coiler roll in order to face said circumference of said sliver coiler roll.

8. The apparatus as defined in claim 7, further including:

means for moving said auxiliary sliver-guide means away from said sliver coiler roll for introduction of said sliver and into an optimum setting with respect to said counter roll.

9. The apparatus as defined in claim 5, wherein:

at least one roll of said pair of rolls contains a substantially concave sliver guide surface.

10. The apparatus as defined in claim 5, wherein:

at least one roll of said pair of rolls is provided at predetermined locations thereof with channel means;

said at least one roll is mounted for rotation at a shaft; and said channel means constitute flutings extending substantially parallel to said shaft.

11. The apparatus as defined in claim 5, further including:

substantially funnel-shaped sliver guide means;

said sliver having a predetermined direction of sliver travel; and said substantially funnel-shaped sliver guide means being provided upstream of said pair of rolls as viewed in said predetermined direction of sliver travel.

12. The apparatus as defined in claim 11, wherein:

said substantially funnel-shaped sliver guide means comprise a rigid funnel.

13. The apparatus as defined in claim 11, wherein said substantially funnel-shaped sliver guide means contain a port portion; and said substantially funnel-shaped sliver guide means comprise a pair of aprons extending between said pair of rolls and said port portion and defining between the aprons an angle converging in a direction toward said pair of rolls.

14. The apparatus as defined in claim 11, further including:

a pair of aprons provided in addition to said substantially funnel-shaped sliver guide means; and said pair of aprons cooperating with said pair of rolls for guiding said sliver upstream of said pair of rolls as viewed in said predetermined direction of sliver travel and defining between said pair of aprons an angle converging in a direction toward said pair of rolls.

15. The apparatus as defined in claim 5, wherein:

the other roll of said pair of rolls defines a counter roll for said sliver coiler roll; and said sliver coiler roll having a larger diameter than said counter roll.

16. The apparatus as defined in claim 5, wherein:

the other roll of said pair of rolls defines a counter roll for said sliver coiler roll;

said sliver coiler roll and said counter roll having substantially the same diameter; and said sliver coiler roll being located at a lower level than said counter roll in order to project into said sliver can.

17. The apparatus as defined in claim 5, further including:

a laterally open guide channel for guiding the sliver between said primary sliver guide means and said pair of rolls;

drive means for rotating said coiler section conjointly with said pair of rolls about said predetermined axis of rotation in a predetermined direction of rotation; and said laterally open guide channel conjointly with said coiler section rotating about said predetermined axis of rotation under the action of said drive means.

18. The apparatus as defined in claim 17, wherein:

said laterally open guide channel possesses a lateral channel opening;

said laterally open guide channel being rotatable in a predetermined direction of rotation under the action of said drive means; and said lateral channel opening being provided at a rear side of said laterally open guide channel as viewed in said predetermined direction of rotation such that the sliver is substantially wind-screened as the sliver passes through said laterally open guide channel.

19. The apparatus as defined in claim 17, wherein:

said laterally open guide channel possesses a lateral channel opening;

said laterally open guide channel being rotatable in a predetermined direction of rotation under the action of said drive means; and said lateral channel opening being provided at a front side of said laterally open guide channel as viewed in said predetermined direction of rotation of said laterally open guide channel.

20. The apparatus as defined in claim 5, wherein:

said sliver coiler roll having a predetermined axis of rotation; and said predetermined axis of rotation of said sliver coiler roll extending substantially perpendicular to said predetermined axis of rotation of said coiler section.

21. The apparatus as defined in claim 6, further including:

a disc supported in said sliver can for displacement relative to said sliver coiler roll;

said disc carrying said coiled sliver layers containing said uppermost sliver layer and deposited in said sliver can; and spring means spring-loading said disc carrying said coiled sliver layers containing said uppermost sliver layer, in a direction toward said sliver coiler roll for holding said delivered sliver at said predetermined pressure between said uppermost coiled sliver layer and said circumference of said sliver coiler roll.

22. An apparatus for filling a sliver can with sliver, comprising:

a can coiler;

a primary sliver guide means;

a coiler section defining part of said can coiler and having a predetermined axis of rotation;

said primary sliver guide means guiding the sliver substantially along said predetermined axis of rotation of said coiler section;

said can coiler including a pair of rolls revolving with said coiler section;

said pair of rolls serving to deliver the sliver to a can located below said pair of rolls;

one roll of said pair of rolls defining a sliver coiler roll;

said sliver coiler roll being positioned for projecting into the can;

auxiliary sliver-guide means;

said sliver coiler roll having a circumference;

said auxiliary sliver-guide means being located opposite said sliver coiler roll and being directed toward said circumference of said sliver coiler roll;

means for moving said auxiliary sliver-guide means away from said sliver coiler roll for introduction of said sliver;

a sliver stripper provided for said auxiliary sliver-guide means; and said sliver stripper constituting a fiber stripper for the other roll of said pair of rolls and said other roll coacts with said sliver coiler roll.

23. An apparatus for filling a sliver can with sliver, comprising:

a can coiler;

a primary sliver guide means;

a coiler section defining part of said can coiler and having a predetermined axis of rotation;

said primary sliver guide means guiding the sliver substantially along said predetermined axis of rotation of said coiler section;

said can coiler including a pair of rolls revolving with said coiler section;

said pair of rolls serving to deliver the sliver to a can located below said pair of rolls;

one roll of said pair of rolls defining a sliver coiler roll;

said sliver coiler roll being positioned for projecting into the can; and fiber stripper means provided for said sliver coiler roll.

24. The combination of a sliver can and a can coiler for filling the sliver can with sliver, wherein:

the can coiler includes a coiler section having a predetermined axis of rotation along which there is guided the sliver;

said can coiler including a pair of rolls revolving with said coiler section;

said pair of rolls serving to deliver the sliver for depositing coiled sliver layers in the sliver can located beneath said pair of rolls;

one roll of said pair of rolls defining a sliver coiler roll; and said sliver coiler roll projecting into said sliver can for directly and immediately placing delivered sliver at a predetermined pressure upon the uppermost coiled sliver layer of the coiled sliver layers deposited in the sliver can.

* * * * *